US005096126A

United States Patent [19]

Giroux et al.

[11] Patent Number: 5,096,126

[45] Date of Patent: Mar. 17, 1992

[54] ELECTROSTATIC SPRAYING INSTALLATION FOR SPRAYING AN ELECTRICALLY CONDUCTIVE LIQUID PRODUCT AND ELECTRICAL INSULATION DEVICE FOR A DISTRIBUTION CIRCUIT FOR AN ELECTRICALLY CONDUCTIVE LIQUID PRODUCT

[75] Inventors: Patrice Giroux, Saint Egreve; Jean-Christophe Rey, Echirolles, both of France

[73] Assignee: Sames S. A., Mehlan, France

[21] Appl. No.: 508,896

[22] Filed: Apr. 12, 1990

[30] Foreign Application Priority Data

Apr. 19, 1989 [FR] France ..... 89 05220

[51] Int. Cl.[5] ..... B05B 5/16

[52] U.S. Cl. ..... 239/690; 239/691; 118/629; 361/228

[58] Field of Search ..... 239/690, 691; 118/621, 118/629; 361/227, 228

[56] References Cited

U.S. PATENT DOCUMENTS

| | | | |
|---|---|---|---|
| 4,629,119 | 12/1986 | Plunkett et al. | 239/690 |
| 4,884,745 | 12/1989 | Spongh | 239/691 |
| 4,884,752 | 12/1989 | Plummer | 239/691 |
| 4,921,169 | 5/1990 | Tilly | 239/690 |
| 4,932,589 | 6/1990 | Diana | 239/691 |
| 4,962,724 | 10/1990 | Prus et al. | 239/690 |
| 4,993,644 | 2/1991 | Klemm | 239/690 |

FOREIGN PATENT DOCUMENTS

| | | | |
|---|---|---|---|
| 8705832 | 10/1987 | European Pat. Off. . | |
| 2635990 | 3/1990 | France | 239/690 |
| 2166982 | 5/1986 | United Kingdom | 239/690 |

*Primary Examiner*—Andres Kashnikow
*Assistant Examiner*—Lesley Morris
*Attorney, Agent, or Firm*—Spensley Horn Jubas & Lubitz

[57] ABSTRACT

At least part of an electrostatic spraying installation for spraying an electrically conductive liquid product such as a coating product is grounded. The installation includes at least one intermediate storage tank that is electrically insulated from ground and at least one electrostatic sprayer device that is supplied from this intermediate storage tank. The electrostatic sprayer device is connected to a variable or switchable high-tension voltage source. The installation includes at least one electrical insulation device which incorporates a section of insulative conduit and a liquid inlet and a liquid outlet at respective ends of this conduit section. A piston movable in the conduit section scrapes its inside wall clean.

21 Claims, 3 Drawing Sheets

ELECTROSTATIC SPRAYING INSTALLATION FOR SPRAYING AN ELECTRICALLY CONDUCTIVE LIQUID PRODUCT AND ELECTRICAL INSULATION DEVICE FOR A DISTRIBUTION CIRCUIT FOR AN ELECTRICALLY CONDUCTIVE LIQUID PRODUCT

BACKGROUND OF THE INVENTION

1. Field of the Invention

The invention concerns an electrostatic spraying installation for spraying an electrically conductive liquid product, in particular a coating product such as a water-based paint or a metallic paint; the invention is more particularly concerned with an improvement for establishing quickly and effectively the necessary electrical insulation between the spraying device at the high-tension voltage and other parts of the installation that are grounded, for example distribution circuits and/or storage tanks for such liquids.

The invention is also concerned with an electrical insulation device for a distribution circuit for an electrically conductive liquid product.

2. Description of the Prior Art

In an electrostatic spraying installation for spraying a coating product that is a relatively good electrical conductor, for example a water-based paint as mentioned above, all parts of the circuit supplying the sprayer device must in principle be insulated from ground potential. This is not possible in the case of a large installation. For example, if the paint spraying installation is part of an automobile manufacturing plant it comprises a number of very long closed loop paint circuits which may extend across an entire portion of the plant to connect the various spraying booths to large paint storage tanks. It is necessary to provide at least one such circuit for each color and another circuit of the same kind for the solvent or cleaning product. For obvious safety reasons these circuits must be grounded. Also, inside each spraying booth the electrostatic sprayer devices are advantageously connected to a high-tension voltage source. If the paint used is electrically conductive it is therefore essential to insulate electrically the sprayer device and the high-tension voltage source from the parts of the structure that must be grounded.

A known solution to this problem involves the use of an intermediate storage tank of relatively small capacity that is electrically insulated from ground and is adapted to be supplied with coating product intermittently. A variable or switchable high-tension voltage source is then provided together with means for separating or at least electrically insulating the intermediate storage tank during phases in which the coating product is sprayed from the parts of the structure that are permanently grounded.

The invention concerns a new electrical insulation device adapted to be inserted between the parts of the structure that are grounded and those which may be at a high-tension voltage.

SUMMARY OF THE INVENTION

In one aspect, the invention consists in an electrostatic spraying installation for spraying an electrically conductive liquid product such as a coating product and at least part of which is grounded, said installation comprising at least one intermediate storage tank insulated from ground, at least one electrostatic sprayer device adapted to be supplied from said at least one intermediate storage tank, a variable or switchable voltage source to which said at least one electrostatic sprayer device is connected and at least one electrical insulation device, said at least one electrical insulation device comprising a section of electrically insulative conduit, a liquid inlet and a liquid outlet at respective ends of said conduit section, a piston mobile in said conduit section and adapted to scrape clean its inside wall and means for displacing said piston in said conduit section.

In another aspect, the invention consists in an electrical insulating device for a distribution circuit for an electrically conductive liquid product comprising a section of electrically insulative conduit, a liquid inlet and a liquid outlet at respective ends of said conduit section, a piston mobile in said conduit section and adapted to scrape clean its inside wall and means for displacing said piston in said conduit section.

The invention will be better understood and other advantages of the invention will emerge more clearly from the following description given by way of example only and with reference to the appended diagrammatic drawings.

DETAILED DESCRIPTION OF THE INVENTION

Figure 1:
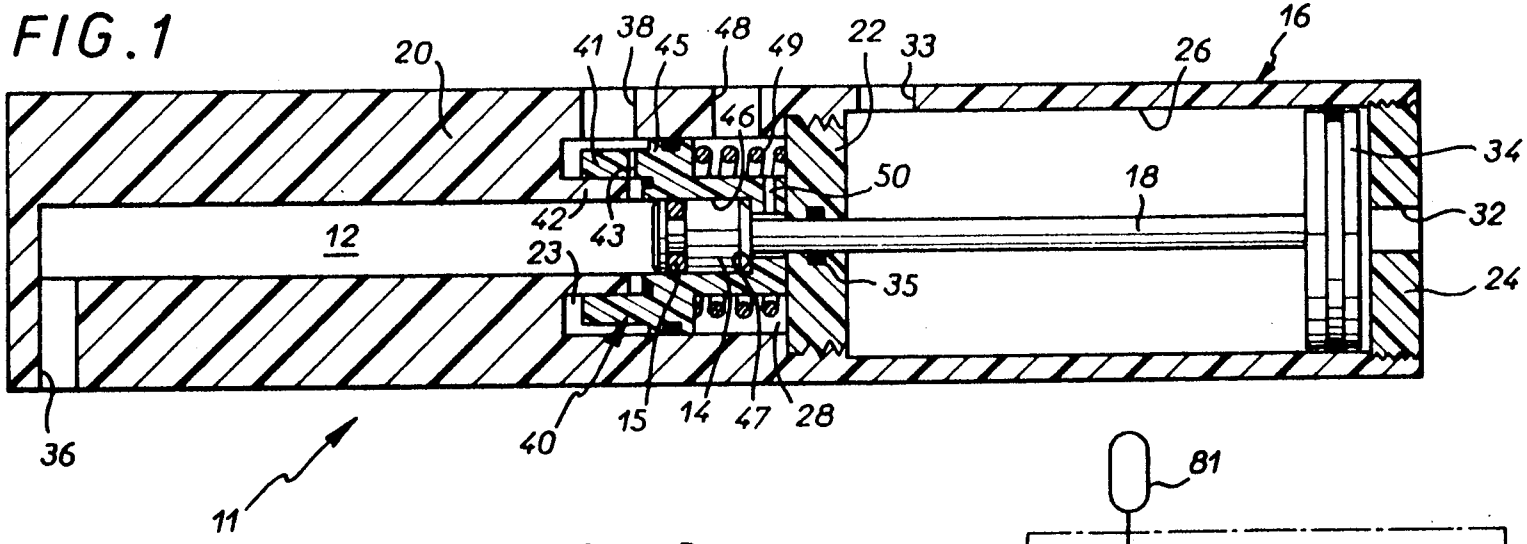
FIG. 1 is a cross section view showing an electrical insulation device in accordance with the invention designed to be inserted into an electrostatic spraying installation for spraying a liquid product that is a relatively good electrical conductor.

FIG. 1 shows an electrical insulation device 11 comprising a section 12 of electrically insulative conduit having a predetermined length, a piston 14 for scraping the inside wall of this conduit section and means for displacing the scraper piston in said conduit section. The scraper piston is fitted with an O-ring 15 of elastomer material which is pressed against the inside wall of the conduit section. In the example the means for displacing the piston are a double-acting pneumatic piston-and-cylinder actuator 16 aligned with the conduit section 12 with an insulative material piston rod 18 fixed to said scraper piston 14. The latter is made from a conductive or insulative material and comprises on the side towards the piston rod 18 a conductive part in contact with the paint to prevent electrical leakage along the piston when the latter in the vicinity of the conduit orifice, as such leaks could damage the seal 15.

The length of the insulative conduit section 12 is predetermined such that the leakage current remains below a chosen value in the presence of a given high-tension voltage between its ends once the inside surface of the conduit section has been sufficiently scraped clean of the conductive product.

In the example shown the straight insulative conduit section 12 is defined within a cylindrical block 20 of a rigid electrically insulative material which also forms the body of the actuator 16 axially aligned with the conduit section 12. The pneumatic actuator 16 is delimited in the axial direction by two walls 22, 24 in the form of plugs screwed into screwthreaded parts of a cylindrical represent recess space formed in the block 20. The wall 22 separates the actuator from a cylindrical cavity 28 which has an annular extension 23 around the conduit section 12; this part will be described in more detail later. The wall 24 closes off an open end of the recess space 26 and includes an orifice 32 adapted to be connected to a source of compressed air (not shown). Another orifice 33 for connection to a source of compressed air is provided near the wall 22. The piston 34 of the actuator 16 moves in the space 26 between the two orifices 32 and 33. One end of the piston rod 18 is fixed to the piston 34 and passes through the wall 22 which accommodates an O-ring 35 providing a seal between the actuator and the cavity 28.

The insulative conduit section 12 is connected directly to an orifice 36 at its end away from the actuator and communicates with an orifice 38 opening into said annular extension 23 via an isolating valve 40 that will be described later.

In the example described it will be assumed that the orifice 38 constitutes a liquid inlet and that the orifice 36 constitutes a liquid outlet but it should be noted that the device may be connected the other way around (depending on its location in the installation), as will be explained later, in which case the orifice 36 is the liquid inlet and the orifice 38 is the liquid outlet.

The function of the isolating valve 40 in the vicinity of one end of said insulative conduit section 12 is to interrupt the circulation of liquid between the nearby orifice 38 and said insulative conduit section 12. This valve is urged at all times towards its closed position and is opened by the scraping system itself when the latter is in the vicinity of this end of said insulative conduit section 12, that is to say when it is in abutting engagement at the actuator 16 end, as shown in FIG. 1.

To this end said isolating valve 40 incorporates a tubular isolating member 45 fitted with a cylindrical sleeve 41 sliding on an inside bearing surface 42 of said annular extension 23 of the cavity 28. The orifice communicates with the annular extension 23 and the sleeve 41 includes a passage 43 (a simple hole in this case) for the liquid to flow through.

The seal between the inlet 38 and the conduit portion 12 is provided by the bearing engagement of the surface at the end of the bearing surface 42 against the facing surface of the isolating member 45, which may be fitted with a resilient seal.

The cavity 28 is coaxial with the conduit section 12 and communicates with the latter in such a way that the tubular isolating member 45 is constrained to move in the axial extension of the conduit section 12 of which it constitutes one end. It incorporates a bore 46 extending and of the same diameter as the conduit section 12. At the end of its travel the scraper piston 14 is inserted into this bore until it reaches a shoulder 47. A spring 49 is fitted in the cavity 28 between the fixed wall 22 and a shoulder of said tubular isolating member 45. It is prestressed when fitted so as to urge said tubular isolating member towards its closed position. Said cavity 28 communicates via an orifice 48 with a compressed air supply (not shown). The pressure established in this way in the cavity 28 also urges the isolating member 45 towards its closed position. Because of the presence of a hole 50 in the isolating member this pressure is exerted on the rear of the scraper piston, in other words the side which is not in contact with the liquid in the conduit section 12. In this way the piston 14 is acted on by air pressure opposing the pressure exerted by the liquid in the conduit section 12. This arrangement balances to some degree the pressure on either side of the scraper piston 14 and defines a kind of "air seal" preventing infiltration of liquid along the lateral wall of the scraper piston and increasing the service life of the O-ring 15.

The operation of the device as just described is obvious from the foregoing description.

The device is connected in such a way that the conduit 12 is inserted into a distribution circuit for an electrically conductive liquid. When the scraper piston 14 is in the position shown in FIG. 1 (air pressure present at the orifice 33 in the actuator 16) it pushes back the isolating member which slides towards the right as seen in FIG. 1 and the passage 43 is uncovered. The conductive liquid can therefore flow between the orifices 38 and 36.

If it is necessary to interrupt the flow of this liquid to procure electrical insulation between the two parts of the liquid distribution circuit it is sufficient to interchange the pressure in the two chambers of the actuator 16 to move the scraper piston 14. As soon as it begins to move said scraper piston releases the sliding isolating member 45 which cuts off the flow of liquid. The scraper piston 14 then continues to move inside the conduit section 12, pushing back the liquid and simultaneously cleaning the inside wall of said conduit so that, when it arrives at the end of its travel, there is in the circuit a portion of insulative conduit sufficiently cleaned of the conductive product to "withstand" a predetermined high-tension voltage.

Figure 2:
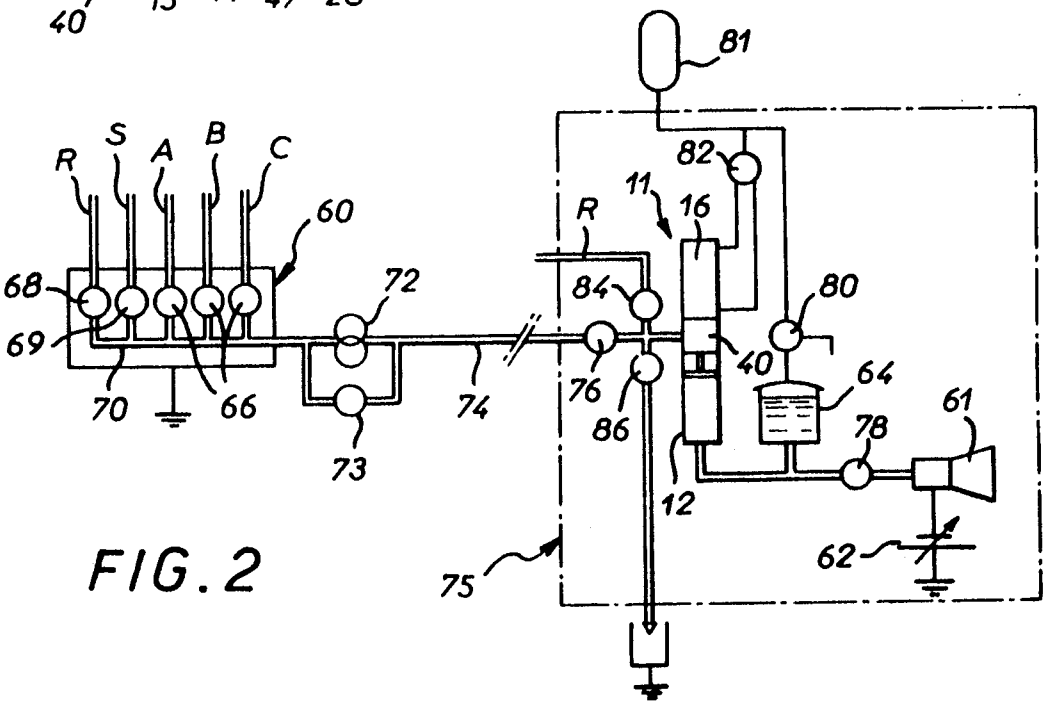
FIG. 2 is a schematic of a first liquid coating product spraying installation incorporating an insulation device of this kind.

FIG. 2 is a schematic showing an electrostatic spraying installation for spraying an electrically conductive liquid coating product. This installation essentially comprises a known coating product change unit 60, at least one electrostatic sprayer 61 for said coating product connected to a variable or switchable high-tension voltage source 62, an intermediate storage tank 64 holding a quantity of coating product and an insulating device 11 as shown in FIG. 1. The intermediate storage tank 64 is structurally insulated from ground. The insulating device 11 is shown in a highly schematic manner with its three essential parts: the insulative conduit section 12, the isolating valve 40 and the actuator 16. In the conventional way the coating product change unit 60 comprises respective valves 66 connected to different coating product distribution circuits A, B, C, a valve 68 connected to a rinsing product distribution circuit R and a valve 69 connected to a compressed air distribution circuit S. All these valves discharge into a common manifold 70 connected to a volumetric flowmeter 72 of the gear type, for example. A by-pass valve 73 is connected in parallel with the flowmeter 72. The output of the flowmeter is connected to an insulative flexible hose 74, usually a few meters long, connected to a sprayer unit 75. The coating product change unit 60 is structurally grounded. The hose 74 is connected to a connecting valve 76 the outlet from which is connected to the isolating valve 40. The "outlet" of the insulative conduit section 12 is connected to the intermediate storage tank 64 and to the sprayer device 61 via a valve 78. Said insulative conduit section 12 is therefore structurally inserted between the coating product change unit 60 and the intermediate storage tank 64. The latter is in this instance a sealed and pressurized container the upper part of which receives compressed air via a pressure regulator 80. The actuator 16 is operated by a compressed air supply 81 via a three-way valve 82. Finally, the rinsing product distribution circuit R is connected to the inlet of the isolating valve 40 via a rinsing valve 84. A purge valve 86 for removing waste has its inlet connected to the same point as the rinsing valve. The three valves 76, 84 and 86 are near the insulating device 11, as close as possible to the inlet of the isolating valve 40. The operation of the installation will now be described.

At the beginning of a cycle one of the valves 66 corresponding to a chosen coating product is opened and the coating product concerned flows in the hose 74, through the valve 76 and the isolating valve 40 (which is open) and into the insulative conduit section 12 to accumulate in the intermediate storage tank 64, the valve 78 being closed. During this phase the voltage of the source 62 is reduced to zero. While the intermediate storage tank 64 is filling the regulator 80 is in a position such that the pressure of the coating product can discharge the air contained in the storage tank through its vent orifice.

As soon as a predetermined quantity of coating product has flowed through the flowmeter 72 the valves 66 and 76 are closed and the valve 82 is opened to actuate the actuator 16. As explained above, this leads to closing of the isolating valve 40 and movement of the scraper piston. The coating product contained in the insulative conduit section is therefore pushed back towards the intermediate storage tank 64. When the scraper piston arrives at the end of its travel, the intermediate storage tank and the electrostatic spraying device 61 are electrically insulated from the coating product change unit 60, which is grounded.

Electrostatic spraying of the coating product may begin as soon as the valve 78 is opened and the high-tension voltage is applied. The storage tank 64 is refilled as necessary, between changes of the coating product, during a short interruption to spraying in which the high-tension voltage is reduced to zero and the insulating device 11 is operated.

When the coating product is to be changed, the last filling of the storage tank 64 is extended after closing of the valve 66 by opening the valves 73 and 69. The effect of this is to push back with the air virtually all of the coating product contained in the conduit 74. At this time the valve 76 is closed again and the last spraying phase prior to changing the coating product proceeds normally. During this latter phase, in which the intermediate storage tank 64 is gradually emptied, the coating product change unit 60, the flowmeter 72, the valve 73, the conduit 74 and the valve 76 may be cleaned by successively injecting rinsing product and compressed air by opening the valves 68 and 69 in succession. During this phase the purge valve 86 is open.

When the storage tank 64 is practically empty spraying is interrupted and the valve 78 is closed. The rinsing product is then injected into the insulative conduit section 12 and the intermediate storage tank 64 by opening the valve 84 (with the valve 86 closed). The rinsing product is then discharged through the purge valve 86 (with the valve 84 closed). These operations may be repeated until the conduit section 12 and the intermediate storage tank 64 are completely clean. The final step is to clean the sprayer device 61 and the valve 78 by ejecting first rinsing product and then air through said sprayer device. The installation is then ready to receive another coating product by opening one of the valves 66.

Figure 3:
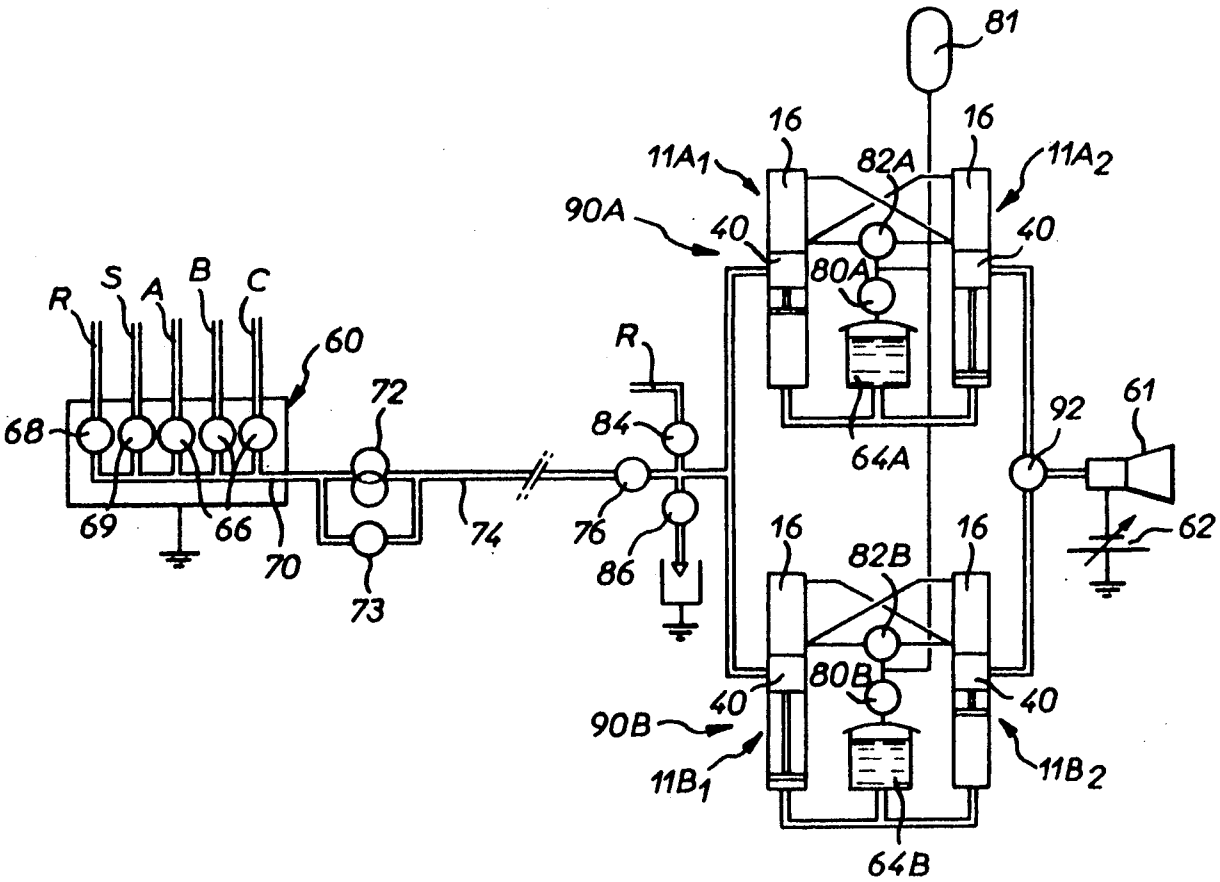
FIG. 3 is a schematic showing a second installation including insulation devices of this kind.

Like the previous installation, that of FIG. 3 includes a liquid coating product change unit 60, a volumetric flowmeter 72, a by-pass valve 73, a connecting valve 76, a rinsing valve 84 and a purge valve 86. The arrangement of these various parts is the same as previously and will not be described in more detail. The installation also includes at least one electrostatic sprayer device 61 and its variable or switchable high-tension voltage source 62. The installation differs from that previously described in that it comprises two branches 90A, 90B for circulation and intermediate storage of the coating product extending in parallel in between the coating product change unit 60 and the electrostatic sprayer device 61 . Each branch 90A or 90B includes a respective intermediate storage tank 64A, 64B insulated from ground, a respective upstream insulating device $\mathbf{11A_1}$, $\mathbf{11B_1}$ and a respective downstream insulating device $\mathbf{11A_2}$, $\mathbf{11B_2}$ An insulating device is "upstream" or "downstream" in the sense that it is upstream or downstream of the intermediate storage tank in the direction of flow of the coating product. Each intermediate storage tank is here of the same kind as previously, in other words a pressurized storage tank fed with compressed air, in this instance from a compressed air supply 81, via a respective pressure regulator 80A, 80B To be more precise, each upstream insulating device $\mathbf{11A_1}$, $\mathbf{11B_1}$ is connected between the point common to the three valves 76, 84 and 86 (by its isolating valve 40) and the corresponding intermediate storage tank 64A, 64B. In other words, the aforementioned three valves are connected to the upstream junction point of the two parallel branches 90A, 90B near the isolating valves of the corresponding two upstream insulating devices. Each downstream insulating device $\mathbf{11A_2}$, $\mathbf{11B_2}$ is connected between the corresponding intermediate storage tank 64A, 64B and an inlet of a three-way valve 92 the outlet of which is connected to the sprayer 61. Each downstream insulating device is connected to the valve 92 via its isolating valve 40. Consequently, in each branch the isolating valve of the upstream insulating device is on the same side as its liquid inlet whereas the isolating valve of the downstream insulating device is on the same side as its liquid outlet, relative to the normal direction of flow of the liquid during a spraying phase. Moreover, in the example described a three-way valve 82A, 82B (connected to the compressed air supply 81) distributing in each branch the air operating the actuator 16 is connected to the actuators by crossed connections adapted to operate said actuators simultaneously in opposite directions.

Finally, note that in this installation the intermediate storage tanks 64A, 64B may be relatively small (with a capacity in the order of 50 $cm^3$, for example) so that they can be cleaned quickly with reduced consumption of rinsing product.

In normal operation the two branches 90A, 90B are switched alternately by appropriate control of the valves 82B, 82B, and 92. Spraying is interrupted only for as long as it takes to change the setting of the three-way valve 92 and this is of no consequence. One of the intermediate storage tanks may be filled while the other is feeding the sprayer device 61. The intermediate storage tank being filled is insulated from the high-tension voltage by the insulative conduit section of its downstream insulating device.

When a change of coating product (color change) is required, the procedure is as follows. On the final filling of one of the intermediate storage tanks, the storage tank 64A, for example, air is injected into the conduit 74 to push back the major part of the coating product into the intermediate storage tank being filled. Then, when the storage tank 64B is empty, the branches 90A and 90B are changed over one last time to complete spraying by supplying the sprayer device 61 from the intermediate storage tank 64A. During this time it is possible to clean the color change unit 60, the volumetric flowmeter 72 and the hose 74 and then to feed the next coating product as far as the closed valve 76, as explained for the FIG. 2 installation. The branch 90B is then cleaned as far as the downstream insulating device 11$B_2$, in the same way as described for the FIG. 2 installation. The insulating device 11$B_2$ is already scraped clean as far as its isolating valve 40.

On completion of spraying of the coating product from the intermediate storage tank 64A, spraying is interrupted for the time necessary to change from one object to be coated to the next. During this time the high-tension voltage is reduced to zero. The branch 90A is then cleaned in the same way as the branch 90B and then the parts between the isolating valves of the downstream insulating devices and the sprayer device 61 are cleaned. To do this rinsing liquid is alternately forced through the downstream insulating devices and discharged through the sprayer device 61. When all of the installation has been purged by injecting compressed air the new coating product may be admitted into one of the intermediate storage tanks and the spraying of this product may begin while the second intermediate storage tank is filling.

The installation that has just been described enables the coating product to be changed extremely quickly, in particular because of the small volumes to be cleaned, as explained above, and also because the time for which spraying is interrupted is reduced to the time needed to clean only one of the two branches and the sprayer device itself.

Figure 4:
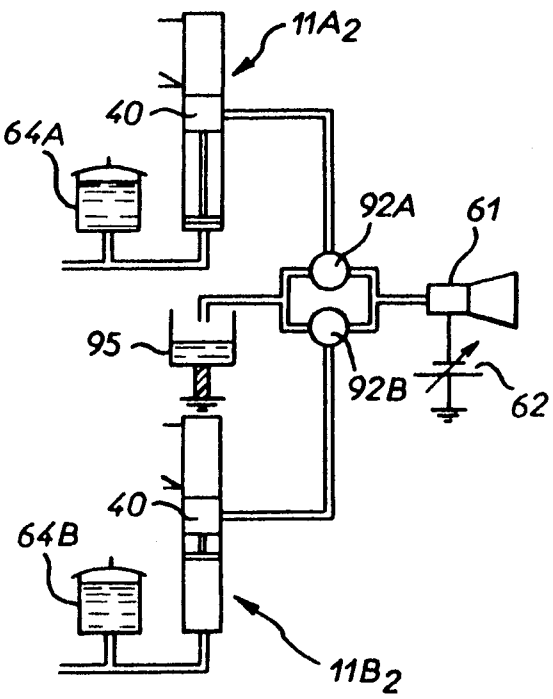
FIG. 4 is a schematic showing an alternative form of the installation from FIG. 3.

To facilitate cleaning, and most importantly to avoid passing too much rinsing product through the sprayer device 61, the FIG. 3 installation may be modified by adding the FIG. 4 arrangement. In this each isolating valve 40 of the downstream insulating device 11$A_2$, 11$B_2$ is connected to one inlet of the respective three-way valve 92A, 92B. Each of these valves has one inlet and two outlets. The outlets are connected in pairs. Two outlets are connected to the sprayer device 61 and the other two are connected to a waste recovery tank 95 which is electrically insulated from ground. The valves 92A, 92B can be disposed near the sprayer 61. With this arrangement only the quantity of rinsing product strictly necessary to clean it is passed through the sprayer device 61. Time is saved because it is then possible to clean one of the branches completely (up to the corresponding valve 92A or 92B) during the final spraying phase using the other branch, and even to fill it with the next coating product.

Figure 5:
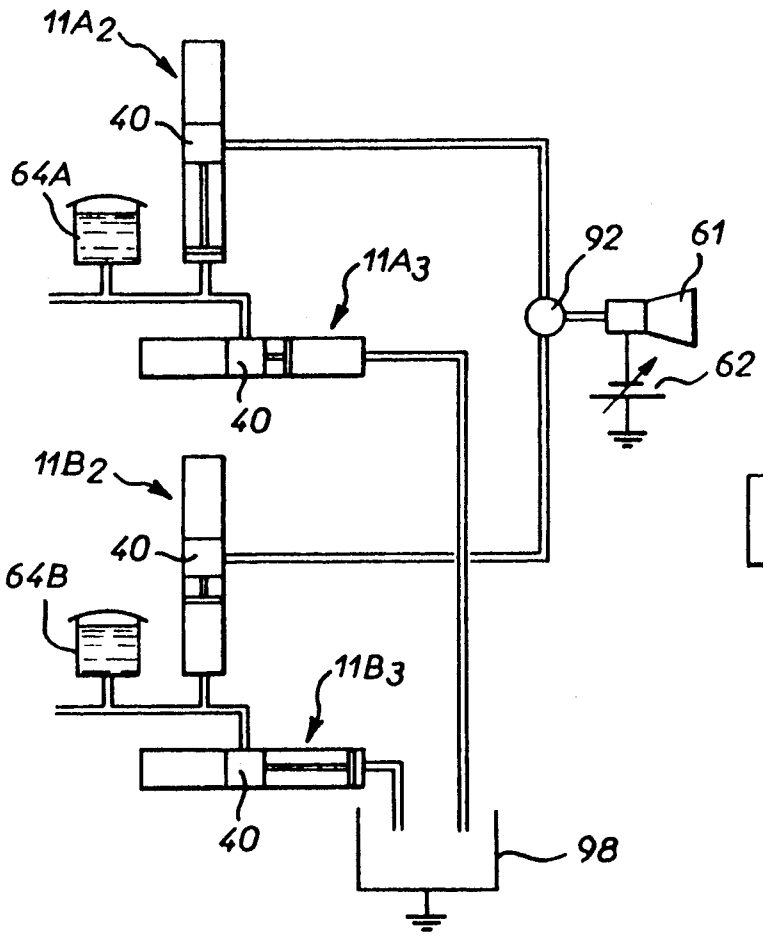
FIG. 5 is a schematic showing an alternative form of the installation from FIG. 4.

If it is not possible to use an insulated waste recovery tank it is still possible to improve the FIG. 3 installation in the manner shown in FIG. 5. In this variant an additional insulating device 11$A_3$, 11$B_3$ is inserted in each branch between the corresponding intermediate storage tank 64A, 64B and a waste recovery tank 98 at ground potential. Each additional insulating device is fitted in such a way that its isolating valve 40 is adjacent the intermediate storage tank. This arrangement simplifies the intermediate storage tank rinsing cycles by eliminating the return of rinsing liquid to the purge valve 86 (see FIG. 3, not shown in FIG. 4), the rinsing liquid always flowing in the same direction, from the valve 84 to the recovery tank 98. The two insulating devices 11$A_3$ and 11$B_3$ are operated in "phase opposition".

In the embodiments previously described the pressurized intermediate storage tanks may be replaced by diaphragm or rigid piston type storage tanks. In a storage tank of this kind, known in itself, the diaphragm or the piston separates the storage tank into two variable volume chambers, one chamber receiving the coating product and the other an actuator fluid (air or liquid) for pressurizing said coating product.

Figure 6:
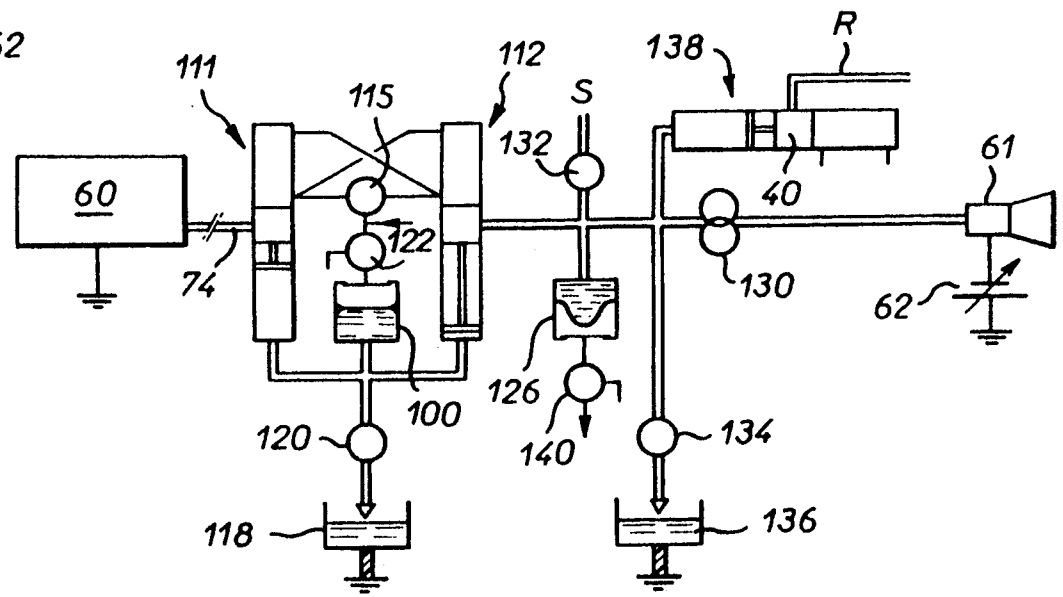
FIG. 6 is a schematic showing a third installation comprising insulation devices as shown in FIG. 1.

The FIG. 6 installation is particularly suitable where it is necessary to supply an electrostatic sprayer device uninterruptedly for long periods. In such cases it is known to use two intermediate storage tanks in cascade.

The installation comprises, as previously, a coating product change unit 60 connected by a hose 74 to a downstream insulating device 111, then to a first intermediate storage tank 100, then to a downstream insulating device 112. The two insulating devices are denoted "upstream" and "downstream" relative to the intermediate storage tank 100. They are mounted in the same way as in a branch from FIG. 3 and operated simultaneously in opposite directions by a three-way valve 115 supplied with compressed air and connected in the same way as a valve 82 from FIG. 3. The point at which the two insulating devices are connected to the intermediate storage tank 100 is connected via a purge valve 120 to a waste recovery tank 118 which is insulated from ground.

In this example the intermediate storage tank 100 is of the kind with a rigid piston separating the coating product from the pressurization fluid. The latter is admitted to the intermediate storage tank via a pressure regulator 122 or any other appropriate control means. The outlet from the insulating device 112 is connected to a second intermediate storage tank 126 and to a volumetric pump 130 supplying the sprayer device 61 which is raised to the high-tension voltage by the high-tension voltage source 62. A compressed air injection valve 132 fed by a supply S, a purge valve 134 and a third insulating device 138 each have one end connected between the outlet from the insulating device 112 and the pump 130. The isolating valve 40 of the third insulating device 138 is connected to the rinsing product distribution circuit R. The outlet from the purge valve 134 discharges into a waste recovery tank 136 which is insulated from ground. Here the intermediate storage tank 126 is of the diaphragm type. The pressurization fluid (compressed air, for example) is admitted to the intermediate storage tank by means of a pressure regulator 140 or any other appropriate control means. The operation of the installation will now be described.

For continuous spraying the storage tank 126 supplies the electrostatic sprayer device 61 through the volumetric pump 130. During this time the intermediate storage tank 100 is connected part of the time to the coating product change unit 60 and part of the time to the intermediate storage tank 126 to fill it. Electrical insulation of the storage tank 100 is normally provided by the insulating device 112 when the intermediate storage tank 100 is connected to the coating product change unit and is therefore at ground potential. When the storage tank 126 must be filled from the storage tank 100 the insulating device 111 electrically insulates the storage tank 100 from the coating product change unit. The volumetric pump 130 produces a constant flow of coating product to the sprayer device.

When the coating product is changed, it is possible, as previously, to clean the storage tank 100 and to fill it with a different coating product while the other storage tank 126 is being emptied of the previous coating product for the last time. The rinsing product and air are supplied by the coating product change unit. The rinsing product is taken off to the insulated recovery tank 118 via the purge valve 120.

Spraying is then interrupted and the high-tension voltage is reduced to zero. The storage tank 126, the pump 130 and the sprayer device 61 are then cleaned and dried. The rinsing product is introduced from the insulating device 138 and the air is introduced by operating the valve 132. The intermediate storage tank 126 can then be filled with coating product taken from the storage tank 100.

Note that in the example just described, as in the examples of FIGS. 3 to 5, simultaneous movement of the two upstream and downstream insulating devices (in this case the devices 111 and 112) does not significantly vary the volume of coating product stored in the intermediate storage tank between these two devices. This can make it possible to control the position of the rigid piston or diaphragm, for example by substituting for the controlling compressed air an incompressible fluid such as electrically insulative oil whose flowrate is controlled. Note also that the intermediate storage tanks described with reference to FIG. 6 may be replaced by air-pressurized intermediate storage tanks like those in FIGS. 2 through 5.

In the embodiments of FIGS. 3 through 6 including "upstream" and "downstream" insulating devices, there are shown and described pairs of such devices fed by a single three-way valve so that they are operated reciprocally, simultaneously and automatically. This avoids any risk of short-circuiting which could arise from the actuation of a single device. However, two three-way valves controlled separately could be used, if required, for example for cleaning, draining and total progressive purging of an intermediate storage tank and insulating devices. The control program would procure opposite movement of the insulating devices, as in the previous case, or conjoint movement in the cleaning phase.

We claim:

1. Electrostatic spraying installation for spraying an electrically conductive liquid product such as a coating product and at least part of which is grounded, said installation comprising at least one intermediate storage tank insulated from ground, at least one electrostatic sprayer device adapted to be supplied from said at least one intermediate storage tank, a variable or switchable voltage source to which said at least one electrostatic sprayer device is connected and at least one insulating device, said at least one electrical insulation device comprising a section of electrically insulative conduit, a liquid inlet and a liquid outlet at respective ends of said conduit section, a piston mobile in said conduit section and adapted to scrape clean its inside wall and means for displacing said piston in said conduit section.

2. Installation according to claim 1 wherein said insulative conduit section is extended axially by an actuator having a piston rod connected to said scraper piston.

3. Installation according to claim 2 comprising an isolating valve near one end of said insulative conduit section and means for opening said isolating valve when said scraper piston is near this end.

4. Installation according to claim 3 wherein said isolating valve includes a tubular isolating member disposed in a cavity in said conduit section and constrained to move coaxially of said conduit section, of which it constitutes a mobile end, between a closed position and an open position, said isolating member including an opening adapted to allow said liquid to flow from or to the interior of said section when it is in said open position.

5. Installation according to claim 4 comprising a spring in said cavity between a fixed wall and a shoulder of said tubular isolating member adapted to urge said tubular isolating member towards its closed position.

6. Installation according to claim 1 wherein the side of said scraper piston which is not in contact with said liquid is adapted to be exposed to air pressure defining an air seal.

7. Installation according to claim 1 wherein the part of the installation that is grounded is a liquid product change unit.

8. Installation according to claim 7 including a connecting valve connected to said liquid product change unit, a rinsing valve connected to a rinsing product supply and a purge valve, said valves being connected upstream of said insulation device, near said insulation device.

9. Installation according to claim 7 comprising two liquid circulation branches extending in parallel between said liquid product change unit and said electrostatic sprayer device, each branch including an intermediate storage tank, an upstream insulation device between said liquid product change unit and said intermediate storage tank, and a downstream insulation device between said intermediate storage tank and said electrostatic sprayer device.

10. Installation according to claim 9 comprising an isolating valve near one end of said insulative conduit section and means for opening said isolating valve when said scraper piston is near this end, wherein said isolating valve of said upstream insulation device is on the same side as its liquid inlet and said isolating valve of said downstream insulation device is on the same side as its liquid outlet.

11. Installation according to claim 10 including a connecting valve connected to said liquid product change unit, a rinsing valve connected to a rinsing product supply and a purge valve, said valves being connected to the point at which said two parallel branches join and near the isolating valves of the corresponding two upstream insulation devices.

12. Installation according to claim 9 wherein each downstream insulation device is connected to one inlet of a three-way valve having respective outlets connected to said electrostatic sprayer device and to a waste recovery tank insulated from ground.

13. Installation according to claim 1 comprising grounded waste recovery means and an additional insulation device connecting said intermediate storage tank to said grounded waste recovery means.

14. Installation according to claim 1 comprising two cascaded intermediate storage tanks a first of which is connected to a grounded part of the installation by an upstream insulation device and to the second intermediate storage tank by a downstream insulation device.

15. Installation according to claim 1 comprising a rinsing product distribution circuit and wherein an intermediate storage tank is connected to said rinsing product distribution circuit by an insulation device.

16. Electrical insulation device for a distribution circuit for an electrically conductive liquid product comprising a section of electrically insulative conduit, a liquid inlet and a liquid outlet at respective ends of said conduit section, a piston mobile in said conduit section and adapted to scrape clean its inside wall and means for displacing said piston in said conduit section.

17. Device according to claim 16 wherein said insulative conduit section is extended axially by an actuator having a piston rod connected to said scraper piston.

18. Device according to claim 17 comprising an isolating valve near one end of said insulative conduit section and means for opening said isolating valve when said scraper piston is near this end.

19. Device according to claim 18 wherein said isolating valve includes a tubular isolating member disposed in a cavity in said conduit section and constrained to move coaxially of said conduit section, of which it constitutes a mobile end, between a closed position and an open position, said isolating member including an opening adapted to allow said liquid to flow from or to the interior of said section when it is in said open position.

20. Device according to claim 16 wherein the side of said scraper piston which is not in contact with said liquid is adapted to be exposed to air pressure defining an air seal.

21. Device according to claim 16 wherein said scraper piston is electrically conductive or includes an electrically conductive part.

* * * * *